US012326009B2

(12) United States Patent
Duffaut et al.

(10) Patent No.: US 12,326,009 B2
(45) Date of Patent: Jun. 10, 2025

(54) SWIMMING POOL CLEANER WITH ILLUMINATED DEBRIS FILTER

(71) Applicant: ZODIAC POOL CARE EUROPE, Bron (FR)

(72) Inventors: Simon Duffaut, Toulouse (FR); Skye Svenningsen, Carlsbad, CA (US); Eugene Keith McQueen, Vista, CA (US)

(73) Assignee: ZODIAC POOL CARE EUROPE, Belberaud (FR)

( * ) Notice: Subject to any disclaimer, the term of this patent is extended or adjusted under 35 U.S.C. 154(b) by 310 days.

(21) Appl. No.: 16/398,331

(22) Filed: Apr. 30, 2019

(65) Prior Publication Data

US 2019/0338545 A1 Nov. 7, 2019

Related U.S. Application Data

(60) Provisional application No. 62/666,835, filed on May 4, 2018.

(51) Int. Cl.
*E04H 4/14* (2006.01)
*E04H 4/16* (2006.01)

(52) U.S. Cl.
CPC ..... *E04H 4/148* (2013.01); *E04H 4/1654* (2013.01)

(58) Field of Classification Search
CPC ..... E04H 4/1654; E04H 4/148
USPC ..... 362/9
See application file for complete search history.

(56) References Cited

U.S. PATENT DOCUMENTS 3,078,998 A * 2/1963 Blumenfeld ..... E04H 4/1654 210/94
3,169,920 A * 2/1965 Payne ..... E04H 4/1209 210/167.1
3,748,810 A * 7/1973 Mattingly ..... E04H 4/0081 52/741.12
3,941,154 A * 3/1976 Bishop ..... B05B 17/08 137/624.15
6,206,547 B1 * 3/2001 Erlich ..... E04H 4/1654 15/1.7

(Continued)

FOREIGN PATENT DOCUMENTS

CN 1540119 A * 10/2004
EP 2821564 1/2015

(Continued)

OTHER PUBLICATIONS

International Application No. PCT/US2019/029775, International Search Report and Written Opinion mailed on Jul. 30, 2019, 12 pages.

(Continued)

*Primary Examiner* — Fatima N Farokhrooz
(74) *Attorney, Agent, or Firm* — Kilpatrick Townsend & Stockton LLP

(57) ABSTRACT

A swimming pool cleaner may include at least one light source within its body. The light source may be positioned to project light onto or into (or both onto and into) an on-board filter of the cleaner, facilitating visual examination of the cleanliness of the in situ filter. A transparent region of the body may permit viewing of the on-board filter from outside the body.

5 Claims, 1 Drawing Sheet

(56) References Cited

U.S. PATENT DOCUMENTS

| | | | | |
|---|---|---|---|---|
| 6,473,927 | B1 * | 11/2002 | Sommer | E04H 4/1654 15/1.7 |
| 7,060,182 | B2 † | 6/2006 | Erlich | |
| 9,657,488 | B2 | 5/2017 | Pichon et al. | |
| 9,714,639 | B2 | 7/2017 | Deery et al. | |
| 2005/0279683 | A1 * | 12/2005 | Erlich | E04H 4/1636 210/167.16 |
| 2010/0065482 | A1 * | 3/2010 | Sumonthee | E04H 4/1654 210/167.1 |
| 2014/0166045 | A1 * | 6/2014 | Herring | E04H 4/1654 134/1 |
| 2015/0191926 | A1 * | 7/2015 | Tavor | E04H 4/1654 210/108 |
| 2017/0114560 | A1 * | 4/2017 | LaCalle Bayo | G21F 9/001 |
| 2017/0212523 | A1 * | 7/2017 | Witelson | G05D 1/0016 |
| 2017/0260766 | A1 * | 9/2017 | Hui | A47L 9/2884 |
| 2018/0010568 | A1 | 1/2018 | Deery et al. | |
| 2018/0155948 | A1 * | 6/2018 | Tavor | E04H 4/1654 |
| 2018/0229160 | A1 * | 8/2018 | Witelson | B01D 33/48 |
| 2018/0283029 | A1 * | 10/2018 | Tailleur | E04H 4/1654 |
| 2018/0328502 | A1 * | 11/2018 | Hayes | F16K 15/02 |
| 2020/0150679 | A1 * | 5/2020 | Yu | E04H 4/1654 |

FOREIGN PATENT DOCUMENTS

| | | |
|---|---|---|
| WO | 2007136831 | 11/2007 |
| WO | 2016026059 | 2/2016 |

OTHER PUBLICATIONS

European Application No. 19723292.9, Notice of Decision to Grant mailed on Feb. 17, 2022, 2 pages.

Australian Application No. 2019262990, Notice of Acceptance mailed on Apr. 5, 2023, 3 pages.

* cited by examiner
† cited by third party

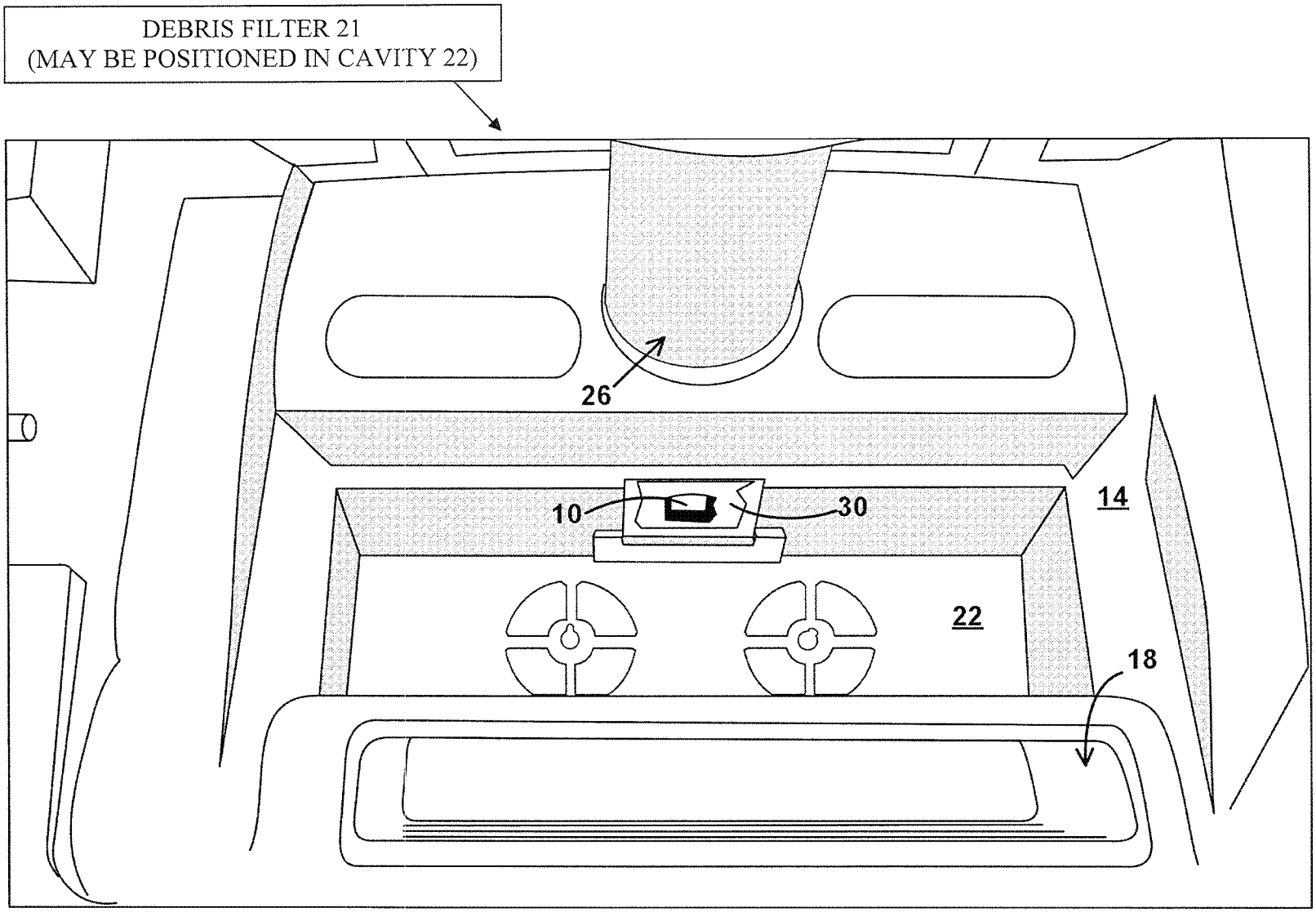
DEBRIS FILTER 21
(MAY BE POSITIONED IN CAVITY 22)
26
10
30
14
22
18

SWIMMING POOL CLEANER WITH ILLUMINATED DEBRIS FILTER

CROSS-REFERENCE TO RELATED APPLICATION

This application claims the benefit of and priority to U.S. Provisional Patent Application Ser. No. 62/666,835, filed May 4, 2018, and having the same title as appears above, the entire contents of which application are hereby incorporated herein by this reference.

FIELD OF THE INVENTION

This invention relates to cleaning devices for water-containing vessels such as swimming pools and spas and more particularly, although not necessarily exclusively, to swimming pool cleaners whose debris filters may be illuminated to facilitate determination of their cleanliness.

BACKGROUND OF THE INVENTION

Automatic swimming pool cleaners (APCs) are well known. These cleaners often are categorized as either "hydraulic" or "robotic" (or "electric"), depending on the source of their motive power. Hydraulic cleaners, for example, typically use pressurized (or depressurized) water to effect their movement within pools, whereas robotic cleaners typically utilize an electric motor to cause their movement. Moreover, hydraulic cleaners frequently are sub-categorized as either "pressure-side" or "suction-side" devices, with pressure-side cleaners receiving pressurized water output from an associated water-circulation pump and suction-side cleaners, by contrast, being connected to an inlet of the pump.

Suction-side APCs conventionally lack any on-board debris filters, instead allowing the debris to pass through their bodies, through connecting hoses, to fixed-location filters associated with the water-circulation system of the pool. Pressure-side and robotic cleaners generally include debris filters that move together with the cleaners: Filters of pressure-side APCs frequently are positioned externally of, but are attached to, the cleaner bodies, whereas debris filters of robotic cleaners often are positioned within the cleaner bodies.

Commonly-owned U.S. Pat. No. 9,657,488 to Pichon, et al., details an exemplary APC. As is conventional for robotic APCs, that of the Pichon patent includes an on-board filtration device comprising a basket and a cover. The filtration device may be positioned between an inlet and an outlet of a body of the APC so as to constitute part of a water flow path within the body. Debris-laden water may enter the inlet and pass through the filtration device, with the device retaining much of the debris while allowing the filtered water to pass to the outlet for return to the swimming pool or spa.

As debris accumulates within a filter, cleaning performance and movement of its associated APC may be adversely impacted. Filters additionally have finite internal volumes and thus may become filled with debris. Advantageous, therefore, may be equipment which facilitates determination of the extent to which a filter contains, or is clogged by, debris.

U.S. Patent Application Publication No. 2018/0010568 of Deery, et al., illustrates another exemplary APC. It may be categorized as a pressure-side hydraulic device and include a debris bag external to the body of the APC as well as a controller and one or more light-emitting diodes (LEDs). According to the Deery application:

> . . . the pool cleaner controller can include a sensor to determine when [the] debris bag . . . needs to be emptied. The pool cleaner controller can communicate this needed action to the LED control circuitry, and the LED control circuitry can illuminate the LEDs . . . in a manner to alert the operator of the needed action.

See Deery, p. 4, ¶0046. The LEDs themselves, however, are coupled to a supply mast of the body adjacent a hose attachment adaptor, thus being positioned somewhat remote from the debris bag.

Because the debris bag of the Deery application is external to the body of the APC, the bag is readily visible to a user or operator of the pool. The debris bag hence needs no illumination, and the LEDs described in the application are not designed to illuminate the bag. By contrast, filters placed within bodies of, e.g., robotic cleaners are not typically readily visible to pool users or operators; to visually inspect the cleanliness of such an on-board filter, a user or operator often must remove the filter from the body for viewing. Beneficial, therefore, would be means for allowing visual inspection of an on-board filter without removing the filter from the body and, in some cases, without ceasing operation of the corresponding APC.

SUMMARY OF THE INVENTION

The present invention seeks to satisfy at least this need. In some versions of the invention, at least one light source is included within the body of the APC. The light source may be configured and positioned to project light onto or into (or both onto and into) the on-board filter, facilitating visual examination of the cleanliness of the in situ filter. The invention may be especially useful when a cover of the body is transparent so as to permit viewing of the on-board filter from outside the body.

It thus is an optional, non-exclusive object of the present invention to provide a mechanism for illuminating a filter of a swimming pool cleaner.

It is another optional, non-exclusive object of the present invention to provide a pool cleaner having an on-board debris filter and a light source facilitating visual assessment of the cleanliness of the filter in situ.

It is a further optional, non-exclusive object of the present invention to provide lighting positioned within a swimming pool cleaner also having a body with a transparent region to permit viewing from outside the body.

Other objects, features, and advantages of the present invention will be apparent to those skilled in the relevant art with reference to the remaining text and drawing of this application.

BRIEF DESCRIPTION OF THE DRAWING

The FIGURE depicts portions of an exemplary APC including apparatus for illuminating an on-board filter.

DETAILED DESCRIPTION

The FIGURE illustrates an exemplary placement of light source 10 within body 14 of an APC. As depicted from above, body 14 may comprise one or more water inlets 18 communicating with cavity 22. In use of the APC, a debris filter (not shown) may be positioned within cavity 22 so as to receive debris-laden water entering body 14 through inlets 18. A pump contained within body 14 may evacuate the debris-laden water through the filter, with the filter retaining much of the debris yet allowing the water to pass for eventual return to the swimming pool.

Light source 10 preferably comprises at least one LED. Light source 10 need not necessarily be or comprise LEDs, however, as persons skilled in the art will recognize that other mechanisms for producing visible light exist and may be employed instead. In either circumstance, light source 10 may be connected to any necessary power source and control and operational circuitry.

Various embodiments of the invention contemplate placing light source 10 within motor block 26 of body 14 adjacent cavity 22. Such placement may be beneficial in that motor block 26 typically is sealed so as to prevent ingress of pool water and thus may serve to isolate and protect electronics associated with light source 10 from water intrusion. If light source 10 is so placed, motor block 26 may include a transparent (or other visible-light transmissive) window 30 so as to allow light source 10 to project light into cavity 22—as well as into the debris filter when it is fitted into cavity 22.

Alternatively, light source 10 may be placed elsewhere within (or on) body 14 or, indeed, within or on the debris filter. Regardless of its exact placement, light source 10 preferably illuminates the APC in a manner suitable for facilitating assessment of the extent to which debris is contained within the debris filter. In general, as debris begins to fill or clog the filter, less light from source 10 will be visible to a user or operator of the pool. No special sensor hence is required to assess the cleanliness of the filter, unlike in the APC of the Deery application.

Determination of other characteristics of the debris filter conceivably may be aided by operation of light source 10. As non-limiting examples, illumination of the debris filter may help users or operators to assess whether the filter has become damaged or torn. Depending on its placement, light source 10 may illuminate components of the APC in addition to (or other than) the debris filter as well as the environment surrounding the APC. Further, light source 10 may function to signal or otherwise indicate that the APC is operating or, in conjunction with one or more sensors, activate to indicate that the debris filter has filled or loaded to a designated extent.

Exemplary concepts and combinations of features of the invention may include:

A. A pool cleaner comprising a debris filter and means for illuminating the filter.

B. An APC comprising an on-board debris filter and a light source configured to facilitate visual assessment of the cleanliness of the filter in situ.

C. A robotic-type APC comprising an on-board debris filter, a motor block incorporating a window, and a light source including at least one LED, with the light source positioned within the motor block so that emitted light passes through the window and illuminates the debris filter.

These examples are not intended to be mutually exclusive, exhaustive, or restrictive in any way, and the invention is not limited to these example embodiments but rather encompasses all possible modifications and variations within the scope of any claims ultimately drafted and issued in connection with the invention (and their equivalents). For avoidance of doubt, any combination of features not physically impossible or expressly identified as non-combinable herein may be within the scope of the invention.

The foregoing is provided for purposes of illustrating, explaining, and describing embodiments of the present invention. Modifications and adaptations to these embodiments will be apparent to those skilled in the art and may be made without departing from the scope or spirit of the invention. Additionally, the word "pool" and phrase "swimming pool" as used herein may include vessels such as spas and hot tubs within its definition. Finally, the entire contents of the Pichon patent and Deery application are incorporated herein by this reference.

What is claimed is:

1. A robotic swimming pool cleaner comprising:

a body comprising one or more water inlets and an interior cavity communicating with the one or more water inlets;

a motor block for driving the body; and a light source positioned within the body to illuminate the interior cavity of the body, wherein the motor block is (i) positioned at least partially within the body and (ii) sealed against ingress of pool water, wherein the light source is positioned within the motor block and the motor block incorporates a window through which light emitted from the light source passes.

2. A swimming pool cleaner comprising:

a body comprising an interior cavity;

a light source positioned to illuminate the interior cavity of the body; and a motor block (i) positioned at least partially within the body and (ii) sealed against ingress of pool water, wherein the light source is positioned within the motor block.

3. The swimming pool cleaner of claim 2, wherein the motor block incorporates a window through which light emitted from the light source passes.

4. The swimming pool cleaner of claim 2, wherein the body further comprises one or more water inlets communicating with the interior cavity, wherein the light source is positioned within the interior cavity so the light source is spaced apart from the one or more water inlets.

5. A swimming pool cleaner comprising:

a body comprising one or more water inlets and an interior cavity communicating with the one or more water inlets, wherein the interior cavity is configured to receive debris-laden water entering the body through the one or more water inlets;

a motor block for driving the body; and a light source positioned within the body to illuminate the interior cavity of the body, wherein the motor block is (i) positioned at least partially within the body and (ii) sealed against ingress of pool water, wherein the light source is positioned within the motor block and the motor block incorporates a window through which light emitted from the light source passes.

* * * * *